US009338559B2

(12) United States Patent
Yang et al.

(10) Patent No.: US 9,338,559 B2
(45) Date of Patent: May 10, 2016

(54) MICROPHONE SYSTEM WITH A STOP MEMBER

(71) Applicant: Invensense, Inc., San Jose, CA (US)

(72) Inventors: Jicheng Yang, North Andover, MA (US); Lee J. Jacobson, Cape Elizabeth, ME (US); Sushil Bharatan, Burlington, MA (US); Thomas D. Chen, Cambridge, MA (US)

(73) Assignee: INVENSENSE, INC., San Jose, CA (US)

( * ) Notice: Subject to any disclaimer, the term of this patent is extended or adjusted under 35 U.S.C. 154(b) by 389 days.

(21) Appl. No.: 13/863,807

(22) Filed: Apr. 16, 2013

(65) Prior Publication Data

US 2014/0307909 A1 Oct. 16, 2014

(51) Int. Cl.
*H04R 19/04* (2006.01)
*H04R 19/00* (2006.01)

(52) U.S. Cl.
CPC ..... *H04R 19/04* (2013.01); *H04R 19/005* (2013.01)

(58) Field of Classification Search
CPC ..... B81C 2203/01; B81C 2203/0109; B81C 2203/0145; B81C 2203/0154; B81C 2203/0127; B81C 2201/0257; B81C 2201/0264; B81C 2201/0285; G01L 9/0073; G01L 9/0072; G01L 9/0048; G01L 9/0045; G01L 9/0042; G01L 9/0044; G01D 5/241; G01D 5/2412; G01D 5/2417; G01D 5/24; G01D 5/18; G01D 5/12; H04R 7/24; H04R 7/26; H04R 7/16; H04R 7/20; H04R 7/04; H04R 19/005; H04R 19/04; H04R 2201/003; H04R 1/04; H04R 2499/11; H04R 19/00; H04R 19/016; H04R 1/02; H04R 23/006; H04R 31/00; H04R 31/006; H01L 2924/3025; B81B 2201/0257; B81B 7/0064
See application file for complete search history.

(56) References Cited

U.S. PATENT DOCUMENTS

| | | | | |
|---|---|---|---|---|
| 4,533,795 | A | 8/1985 | Baumbauer, Jr. et al. | 179/111 E |
| 4,776,019 | A | 10/1988 | Miyatake | 381/174 |
| 5,178,015 | A | 1/1993 | Loeppert et al. | 73/718 |
| 5,188,983 | A | 2/1993 | Guckel et al. | 437/209 |
| 5,209,118 | A * | 5/1993 | Jerman | G01L 9/0073 73/715 |
| 5,452,268 | A | 9/1995 | Bernstein | 367/181 |
| 5,490,220 | A | 2/1996 | Loeppert | 381/168 |
| 6,535,460 | B2 * | 3/2003 | Loeppert | B81B 3/0072 367/181 |
| 8,270,634 | B2 * | 9/2012 | Harney | H04R 1/245 381/113 |
| 9,199,837 | B2 * | 12/2015 | Kasai | B81B 7/0016 |
| 9,206,032 | B1 * | 12/2015 | Kang | B81B 3/0051 |
| 2003/0133588 | A1 * | 7/2003 | Pedersen | B81B 3/0072 381/423 |
| 2006/0280319 | A1 * | 12/2006 | Wang | B81B 3/0072 381/172 |
| 2007/0047744 | A1 * | 3/2007 | Harney | H04M 1/035 381/113 |
| 2007/0154040 | A1 * | 7/2007 | Chen | H04R 19/04 381/174 |
| 2010/0096714 | A1 * | 4/2010 | Nakatani | G01L 9/0042 257/419 |
| 2010/0176821 | A1 * | 7/2010 | Kasai et al. | H04R 19/04 324/660 |

(Continued)

*Primary Examiner* — Davetta W Goins
*Assistant Examiner* — Jasmine Pritchard
(74) *Attorney, Agent, or Firm* — Maryam Imam; IPxLaw Group LLP

(57) ABSTRACT

A microphone system has a package with an interior chamber and an inlet aperture for receiving an acoustic signal, and a microphone die having a backplate and a diaphragm. The microphone is positioned within the package interior to form a front volume between the diaphragm and the inlet aperture. Accordingly, the microphone is positioned to form a back volume defined in part by the diaphragm within the interior chamber. The system also has a stop member positioned in the back volume so that the diaphragm is between the stop member and the backplate.

21 Claims, 8 Drawing Sheets

(56) References Cited

U.S. PATENT DOCUMENTS

2011/0075866 A1* 3/2011 Zhang ..... H04R 1/222
381/174
2011/0227177 A1* 9/2011 Nakatani ..... B81B 3/007
257/416
2011/0278684 A1* 11/2011 Kasai ..... G01H 11/06
257/416
2012/0237073 A1* 9/2012 Goida ..... H04R 1/02
381/361
2012/0328132 A1* 12/2012 Wang ..... H04R 19/04
381/174
2013/0140655 A1* 6/2013 Yeh ..... H01L 21/56
257/416
2014/0203380 A1* 7/2014 Theuss ..... B81B 3/0021
257/416
2014/0264650 A1* 9/2014 Liu ..... B81B 3/0078
257/416

* cited by examiner

MICROPHONE SYSTEM WITH A STOP MEMBER

FIELD OF THE INVENTION

The invention generally relates to microphone systems and, more particularly, the invention relates to transducers.

BACKGROUND OF THE INVENTION

MEMS microphones (i.e., microelectromechanical system microphones) typically are secured within the interior chamber of a package to protect them from the exterior environment. An integrated circuit chip, typically mounted within the interior chamber and having active circuit elements, processes electrical signals to and from the microphone. One or more apertures through some portion of the package permit acoustic signals to reach the microphone. Receipt of the acoustic signal causes the microphone, with its corresponding integrated circuit chip, to produce an electronic signal representing the acoustic qualities of the received signal.

Since they are exposed to the exterior environment through their apertures(s), MEMS microphones often are subject to high pressure events that can damage their fragile microstructure.

SUMMARY OF VARIOUS EMBODIMENTS

In accordance with one embodiment of the invention, a microphone system has a package with an interior chamber and an inlet aperture for receiving an acoustic signal, and a single backplate microphone die having a backplate and a diaphragm. The microphone is positioned within the package interior to form a front volume between the diaphragm and the inlet aperture. Accordingly, the microphone is positioned to form a back volume defined in part by the diaphragm within the interior chamber. The system also has a stop member positioned in the back volume so that the diaphragm is between the stop member and the backplate.

The stop member may be spaced a given distance (e.g., between about 5 and about 16 microns) from the generally planar top surface of the diaphragm to limit orthogonal movement of the diaphragm in a direction that is generally normal to the top surface of the diaphragm. The maximum orthogonal movement is about the same as the given distance. That distance may be greater than the distance between the diaphragm and the backplate. Moreover, the stop member may have a floating potential, or a potential that is substantially the same as the potential of the diaphragm.

Some embodiments secure the stop member to the microphone die. For example, the stop member and microphone die may be secured together in a stacked configuration. Other embodiments couple the stop member to at least one interior wall that defines the interior chamber.

To facilitate diaphragm movement, the stop member may be formed as a generally planar member (e.g., a laminate) having at least one opening therethrough. To form the front volume and back volume in the requisite manner, the microphone die may be positioned to substantially cover the inlet aperture.

The package may include a base forming the inlet aperture, and a lid secured to the base. The lid and base also may form the interior chamber and have a plurality of pads on the base (e.g., in the interior chamber, on the exterior package surface, or both surfaces).

In accordance with another embodiment of the invention, a microphone system has a lid that, at least with a base, forms a package having an interior chamber and an inlet aperture for receiving an acoustic signal. The system also has a single backplate microphone die within the interior chamber, and a stop member proximate to the microphone die. The microphone die is mounted over and covers the inlet aperture, and is positioned between the inlet aperture and the stop member.

In accordance with other embodiments of the invention, a microphone system has a lid that, at least with a base, forms a package having an interior chamber and an inlet aperture for receiving an acoustic signal. The system also has a single plate microphone die within the interior chamber—mounted over and covering the inlet aperture. The microphone die has a diaphragm suspended by at least one spring, and a backplate that forms a variable capacitor with the diaphragm. The spring permits the diaphragm to move a maximum distance in a direction that is generally orthogonal to the top generally planar face of the diaphragm. The maximum distance is a distance that would damage the microphone die. Accordingly, the system also has a stop member positioned proximate to and spaced a given distance from the diaphragm in a direction that is generally orthogonal to the top face of the diaphragm. The given distance is less than the maximum dimension. The stop member is positioned between the diaphragm and the lid to prevent the diaphragm from moving more than the given distance in the direction of the lid.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, a MEMS microphone is configured to maintain its structural integrity when subjected to sudden high pressure acoustic signals. To that end, the MEMS microphone has a stop member that limits the distance its flexible diaphragm may travel away from its local backplate.

Specifically, the stop member ensures that the diaphragm cannot move a distance that could potentially damage the diaphragm and/or its springs (among other things). Details of illustrative embodiments are discussed below.

Figure 1:
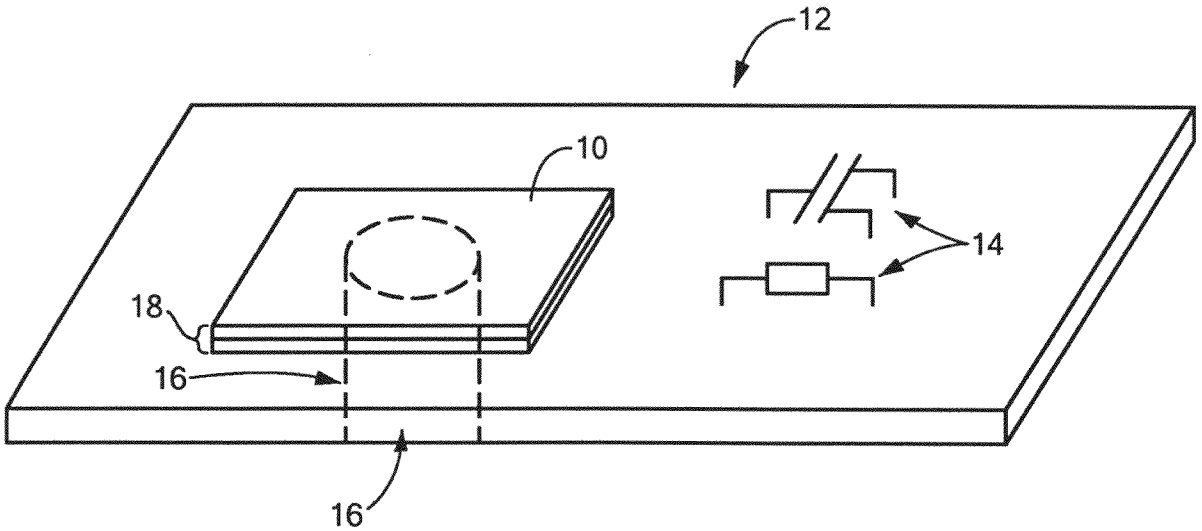
FIG. 1 schematically shows one use of a packaged microphone system configured in accordance with illustrative embodiments of the invention.

FIG. 1 schematically shows one application of a microphone system that can implement illustrative embodiments of the invention. Specifically, FIG. 1 schematically shows a printed circuit board 12 supporting and electrically interconnecting a packaged microphone 10 with additional electronic components 14. The packaged microphone 10 cooperates with on-board and off-board circuitry to convert and deliver audio/acoustic signals to a larger system, such as a mobile telephone or public announcement system.

A board aperture 16 (shown in phantom) extends upwardly through the printed circuit board 12 to the bottom of the microphone package (identified by reference number 18, discussed in detail below). To ensure proper receipt of the acoustic signal, the microphone package 18 may be sealed to the top surface of the printed circuit board 12 by means of a gasket (e.g., formed from an elastomeric or other sealing material, not shown) or without a gasket, such as with some foam or elastomeric material. Accordingly, this arrangement produces an acoustic signal path through the printed circuit board 12, the gasket, and an inlet aperture 30 in the bottom surface of the package 18.

Those skilled in the art can mount the packaged microphone 10 onto the printed circuit board 12 using any of a variety of different techniques. For example, surface mount technology or lead-through-board technologies (e.g., gull wing mounting) should suffice. Moreover, it should be noted that only the packaged microphone 10 and two other miscellaneous circuit components 14 are shown for simplicity. The circuit board 12 thus may have a number of other components, such as additional microphones, resistors, capacitors, transistors, application-specific integrated circuits, traces, contact pads, etc. . . .

Indeed, the packaged microphone 10 of this embodiment has a microphone package 18 that contains both a MEMS microphone (hereinafter "microphone die 20") and application-specific internal circuit ("ASIC 22" or "circuit die 22"). Illustrative embodiments may use a variety of different types of MEMS microphone dies, such as that shown in cross-section by example in FIGS. 4 and 5.

Figure 2:
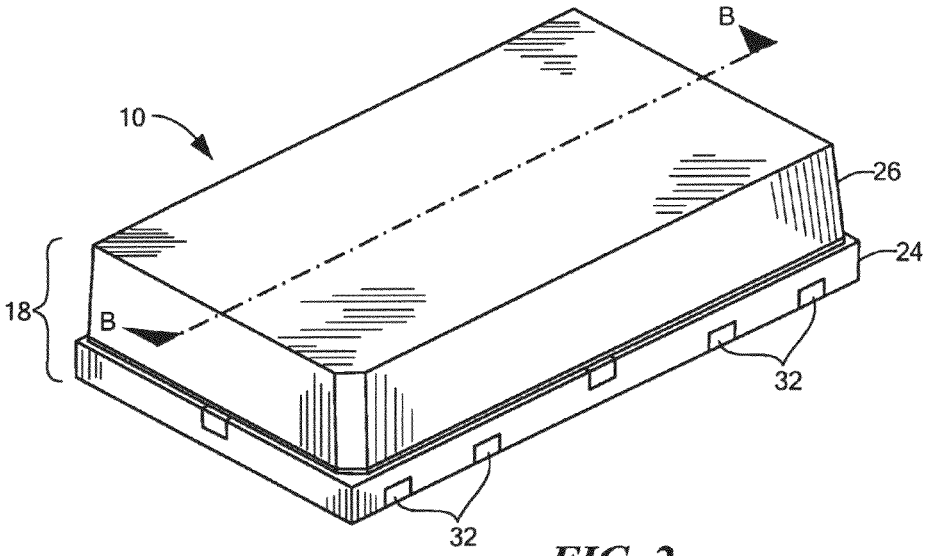
FIG. 2 schematically shows a top view of a packaged microphone that may be configured in accordance with illustrative embodiments of the invention.

To those ends, FIG. 2 schematically shows a top, perspective view of a packaged microphone 10 (also referred to as a "packaged microchip 10" or "microphone system 10") that may be configured in accordance with illustrative embodiments of the invention. In a corresponding manner, FIG. 3 schematically shows a bottom, perspective view of the same packaged microphone 10.

The packaged microphone 10 shown in those figures has a package base 24 that, together with a corresponding lid 26, forms an interior chamber 28 (shown in FIGS. 6A and 7) containing the noted microphone die 20 and, if desired, the noted separate circuit die 22. Alternatively, the microphone die 20 has on-chip circuitry, thus obviating the need for separate microphone circuitry within the chamber 28. The lid 26 in this embodiment is a cavity-type lid, which has four walls extending generally orthogonally from a top, interior face to form a cavity. The lid 26 secures to the top face of the substantially flat package base 24 to form the interior chamber 28. In alternative embodiments, the lid 26 and base 24 combine with other components (e.g., an intervening wall between the lid 26 and the base 24) to form the interior chamber 28. Other embodiments may implement the base 24 as a cavity package (with a bottom and walls extending from a flat surface), and/or the lid 26 in a generally flat planar shape.

Figure 3:
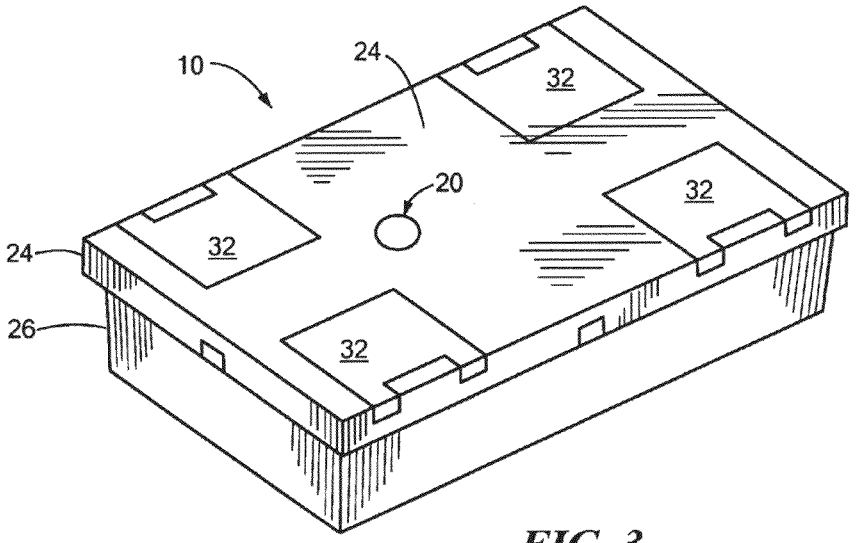
FIG. 3 schematically shows a bottom view of the packaged microphone shown in FIG. 2.

As shown in FIG. 3, the base 24 has an audio/acoustic input port 30 (also referred to as an "input aperture 30" or "inlet aperture 30") that enables ingress of audio/acoustic signals into the interior chamber 28. Acoustic signals entering the interior chamber 28 interact with the microphone die 20 to produce an electrical signal that, with additional (exterior) components (e.g., a speaker and accompanying on-chip or off-chip circuitry), produce an output audible signal corresponding to the input audible/acoustic signal.

In alternative embodiments, however, the inlet aperture 30 is at another location, such as through the top of the lid 26, or through one of the side walls of the lid 26. For example, the inlet aperture 30 can extend through the lid 26 with a connection to the microphone die 20. The package 18 also may have two or more ports/apertures 30. For example, the package 18 could have a second input port (not shown) for directional sound purposes. Accordingly, discussion of a package 18 having its inlet aperture 30 through the base 24 is but one example of a variety of different embodiments.

FIG. 3 also shows a number of base contacts 32 for electrically (and physically, in many anticipated uses) connecting the microphone die 20 with a substrate, such as the printed circuit board 12 of FIG. 1 or other electrical interconnect apparatus. For example, the base contacts 32 may be surface mountable pads or leads. The packaged microphone 10 may be used in any of a wide variety of applications. For example, the packaged microphone 10 may be used with mobile telephones, land-line telephones, computer devices, video games, biometric security systems, two-way radios, public announcement systems, camcorders, and other devices that transduce signals.

In illustrative embodiments, the package base 24 shown in FIGS. 2 and 3 is a premolded, leadframe-type package (also referred to as a "premolded package"). Other embodiments may use different package types, such as, among other types, ceramic cavity packages, substrate packages, or laminate base (e.g., BT) packages. Accordingly, discussion of a specific type of package base is for illustrative purposes only.

The package 18 may have selective metallization to protect it from electromagnetic interference. For example, the lid 26 could be formed from stainless steel, while the base 24 could include printed circuit board material, such as metal layers and FR-4 substrate material. Alternatively, the lid 26 could be formed from an insulator, such as plastic, with an interior conductive layer. Other embodiments contemplate other methods for forming an effective Faraday cage that reduces electromagnetic interference with the internal microphone die 20. Moreover, various embodiments may form the base 24 and lid 26 from similar or the same materials. For example, both can be formed from a laminate, or the lid 26 can be formed from a laminate, while the base 24 can be formed from a carrier or pre-molded leadframe.

Figure 4:
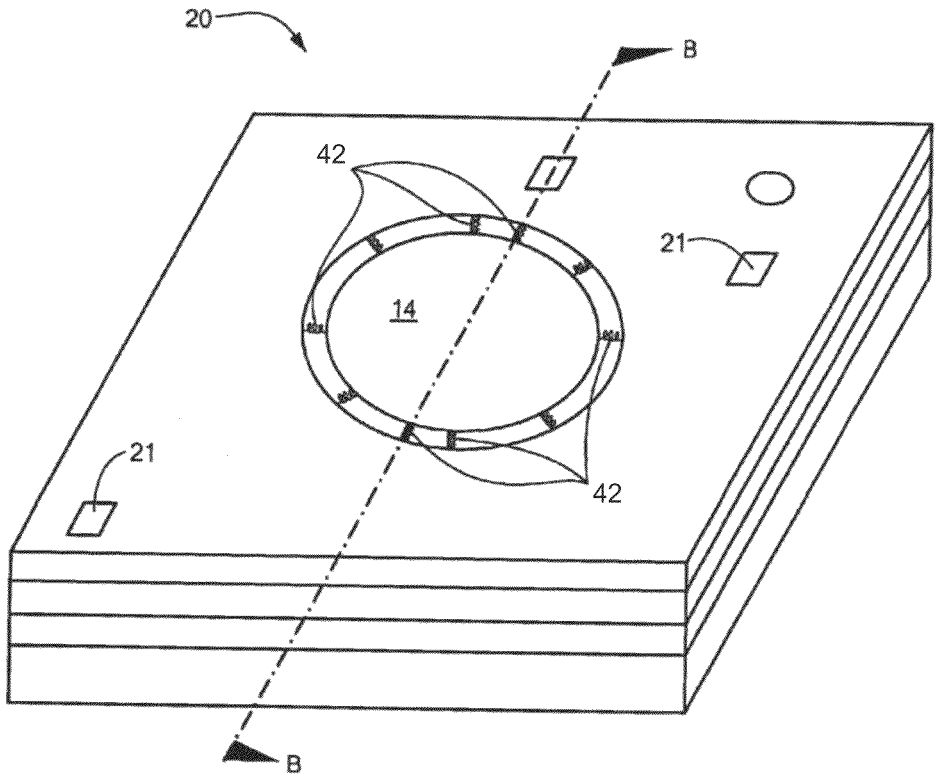
FIG. 4 schematically shows a perspective view of a microphone die that may be used in accordance with illustrative embodiments of the invention.

The interior chamber 28 can contain any of a variety of different types of microphone dies 20. To that end, FIG. 4 schematically shows a perspective view of one type of microphone die 20 that may be used in illustrative embodiments. For more detail, FIG. 5 schematically shows a cross-sectional view of the microphone die 20 of FIG. 4.

Among other things, the microphone die 20 includes a single static backplate 34 that supports and forms a variable capacitor with a flexible diaphragm 36. In illustrative embodiments, the backplate 34 is formed from single crystal silicon (e.g., the top layer of a silicon-on-insulator wafer; a "SOI" wafer), while the diaphragm 36 is formed from deposited polysilicon. Other embodiments, however, use other types of materials to form the backplate 34 and the diaphragm 36. For example, a single crystal silicon bulk wafer, or some deposited material may form the backplate 34. In a similar manner, a single crystal silicon bulk wafer, part of a silicon-on-insulator wafer, or some other deposited material may form the diaphragm 36. To facilitate operation, the backplate 34 has a plurality of through-holes 38 that lead to a backside cavity 40. As discussed below, these through-holes 38 have a secondary function of acting as a filter that helps prevent debris from contacting the diaphragm 36.

Springs 42 movably connect the diaphragm 36 to the static portion of the microphone die 20, which includes the backplate 34. Other embodiments have no springs. Audio/acoustic signals cause the diaphragm 36 to vibrate, thus producing a changing capacitance. On-chip or off-chip circuitry (e.g., the circuit die 22, among other things) receive and convert this changing capacitance into electrical signals that can be further processed. For example, the diaphragm 36 may oscillate about an equilibrium position (i.e., the rest position for the diaphragm 36) in a direction that is generally orthogonal to its top and bottom faces. Normally, this oscillation should be minimal. Undesirably, however, the springs 42 may permit a much greater diaphragm swing about the equilibrium position. This greater swing could be so large as to damage the diaphragm 36 and/or springs 42 (discussed below).

Figure 5:
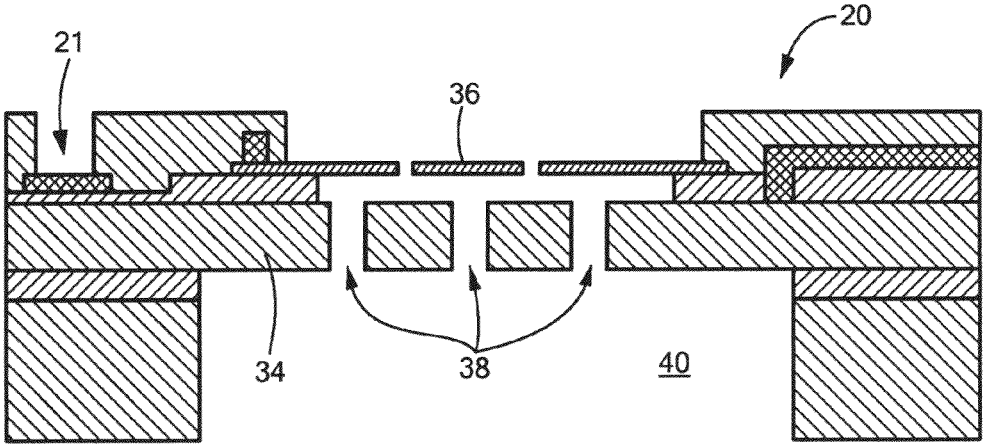
FIG. 5 schematically shows a cross-sectional view of the microphone die shown in FIG. 4.

The microphone shown in FIGS. 4 and 5 often is referred to as a "single backplate microphone." Specifically, this type of microphone has only one backplate 34; namely, the backplate 34 between the diaphragm 36 and the backside cavity 40. Alternative embodiments (not shown in the figures) may divide the backplate 34 into a plurality of sub-backplates 34 that are in the same plane and/or on the same side of the diaphragm 36 and thus, they are still considered a single backplate 34. Accordingly, some backplate embodiments may produce a single variable capacitance, while others produce a single variable capacitance from multiple variable sub-capacitances with one or more diaphragms 36. Because they both use single backplates 34 to reproduce the incoming acoustic signal, both examples thus may be considered to effectively form a single plate variable capacitance. This is in contrast to a double backplate MEMS microphone design, which has backplates on both sides of the diaphragm 36.

It should be noted that discussion of the specific microphone die 20 shown in FIGS. 4 and 5 is for illustrative purposes only. For example, as noted above, the microphone die 20 may have multiple sub-diaphragms 36 facing multiple-sub-backplates 34, or be formed from a bulk silicon wafer and not from an SOI wafer. Other microphone configurations thus may be used with illustrative embodiments of the invention.

The positioning of the diaphragm 36 and backplate 34 presents a balance between having a sufficiently high variable capacitance signal and potential interference with free diaphragm movement. Specifically, while the diaphragm 36 typically is positioned very close to the backplate 34 to provide a strong variable capacitance signal, it preferably is spaced far enough away to not clip the signal by frequently contacting the backplate 34. For example, a diaphragm 36 spaced about 3 to 4 microns away from the backplate 34 should provide sufficient clearance for normal operation of certain microphone dies 20. In that case, that diaphragm 36 normally may vibrate up to about three microns about its equilibrium position (i.e., as noted above, the position of the diaphragm 36 when no acoustic signal is received).

Undesirably, however, the microphone die 20 may be subjected to sudden and sometimes short high pressure events (e.g., pressure spikes) that forcefully move the diaphragm 36 far away from the backplate 34, beyond its normal range. For example, when used within a mobile telephone, a high-pressure event may occur when closing a car door, or positioning the device inside a sealed strong box that is suddenly closed. This can cause a shock or sudden pressure that can forcefully move the diaphragm 36 away from the backplate 34 a substantial distance, which can damage the fragile microstructure (e.g., the diaphragm 36 and springs 42) and disable the microphone die 20. For example, simulations of a specific microphone die 20 similar to that discussed above showed that such shocks can move the diaphragm 36 fifteen or more microns from the equilibrium point. Such simulations of that specific microphone die also demonstrated that displacements of greater than about seventeen microns could actually break the diaphragm 36. In other words, although it does not always damage the diaphragm 36 and/or springs 42, such a large displacement is expected to often damage the diaphragm 36 and/or springs 42—it is outside of the rated range for the microphone die 20.

The inventors responded to this problem by positioning a stop member 44 relatively close to the side of the diaphragm 36 that is opposite the backplate 34. To mitigate the risk of damaging the microphone die 20, the stop member 44 can be positioned a distance from the diaphragm 36 that is less than the maximum distance the diaphragm 36 can travel before being highly likely to break or damage the microstructure. For example, the stop member 44 can be placed between five and fifteen microns from the diaphragm 36 in its equilibrium position—preventing it from exceeding rated distances. Accordingly, the stop member 44 limits diaphragm movement to a distance that should not damage the microphone die components (e.g., the diaphragm 36 and/or the springs 42).

Figure 6A:
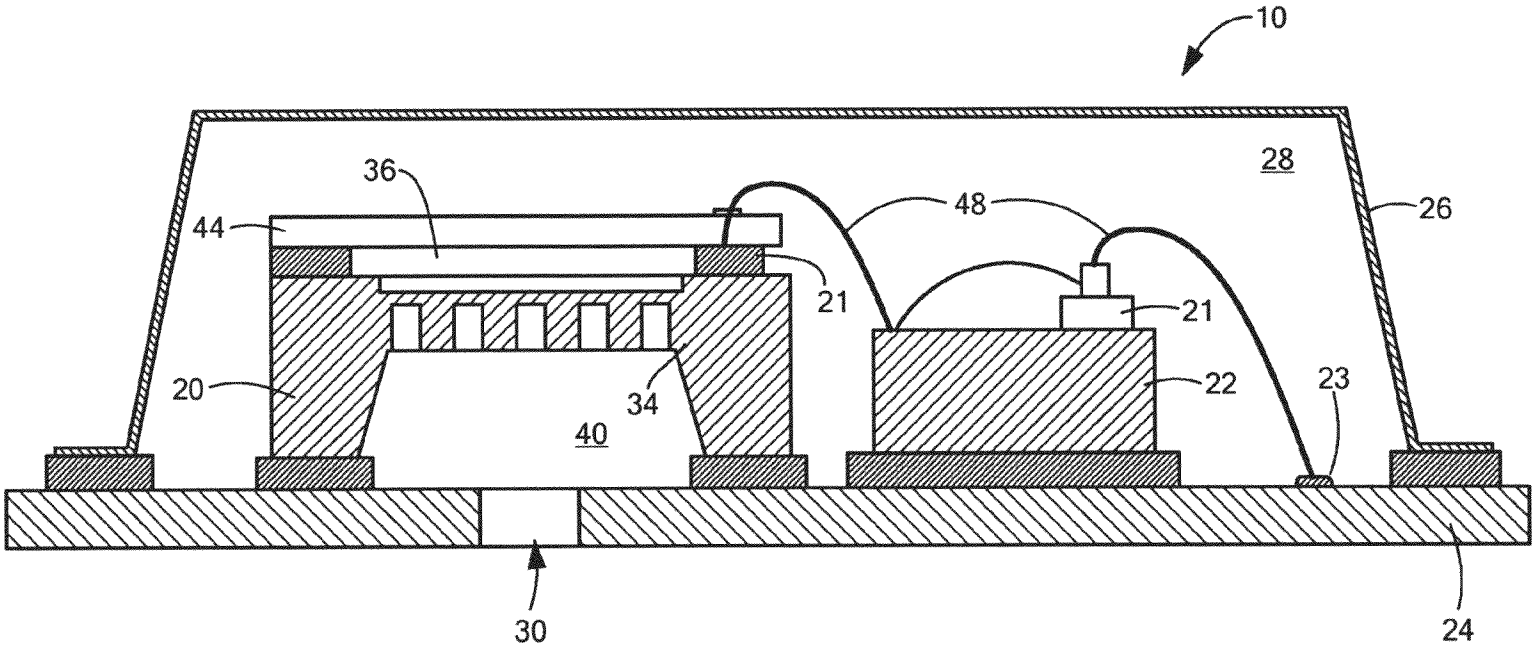
FIG. 6A schematically shows a cross-sectional view of the packaged microphone of FIGS. 2 and 3 in accordance with illustrative embodiments of the invention.

To that end, FIG. 6A schematically shows a cross-sectional view of the packaged microphone 10 of FIGS. 2 and 3 in accordance with illustrative embodiments of the invention. As noted above, the interior chamber 28 has the noted microphone die 20 for receiving incoming acoustic signals, and an ASIC die 22 electrically controlling the microphone die 20 (e.g., biasing its plates and managing signal transmission to and from the package 18). The interior chamber 28 may have additional components that are not shown, such as passive components and integrated passive devices.

The microphone die 20 preferably is mounted directly over and covering the inlet aperture 30. Accordingly, incoming acoustic signals enter the interior chamber 28 and pass through the backside cavity 40 and backplate 34 through-holes 38 before striking the diaphragm 36. As known by those skilled in the art, this region between the inlet aperture 30 and the diaphragm 36 is known as the "front volume" of the microphone die 20, or the front volume of the interior chamber 28. Other embodiments, however, may position the microphone die 20 in other regions of the interior chamber 28. Accordingly, discussion of this embodiment is for exemplary purposes only.

In accordance with illustrative embodiments of the invention, the packaged microphone 10 also has the above noted stop member 44 to protect the structural integrity of the microphone die 20. To that end, the stop member 44 may be directly secured to the microphone die 20 in the back volume of the interior chamber 28. In this embodiment, the stop member 44 is considered to be in a "stacked configuration" with the microphone die 20. Specifically, in this stacked configuration, the stop member 44 is stacked upon the top, generally planar surface of the microphone die 20 within the interior chamber 28. The stop member 44 thus has a generally planar bottom face (from the perspective of these drawings) that is generally parallel with the generally planar top face of the diaphragm 36. Alternative embodiments of the stop member 44, however, may be non-planar, with dimples, curved portions, or other similar features (discussed below).

The stop member 44 may be an integral part of the microphone die 20—formed on the die 20 during the die fabrication/micromachining process. Alternatively, the stop member 44 may be formed as a separate component secured to the microphone die 20 in a post-fabrication processing step (discussed in greater detail below with regard to FIG. 8). Among other things, the stop member 44 may be formed from a heterogeneous or homogeneous material, such as one or more of single crystal silicon, polysilicon, laminate (e.g., BT laminate), circuit board material (e.g., BT laminate or FR-4 circuit board material), metal, ceramic, or other material that may be used in semiconductor or packaging processes.

Illustrative embodiments ensure that the stop member 44 does not appreciably impede the intended movement of the diaphragm 36. To that end, as noted above, the stop member 44 preferably is positioned relatively far from the diaphragm 36 in its equilibrium position. Among other ranges, this gap can range from slightly more the normal range of motion of the diaphragm 36 to multiple times that range. For example, the above discussed microphone having a diaphragm 36 that normally moves about three microns above and below its equilibrium point may position the stop member 44 between about four and about fifteen microns from the diaphragm 36 above the equilibrium position. As such, this embodiment should prevent the diaphragm 36 from moving a distance that could potentially damage the fragile microstructure of the microphone die 20. Moreover, alternative embodiments space the stop member 44 a distance that is the same or closer to the diaphragm 36 than the spacing between the backplate 34 and the diaphragm 36.

Figure 6B:
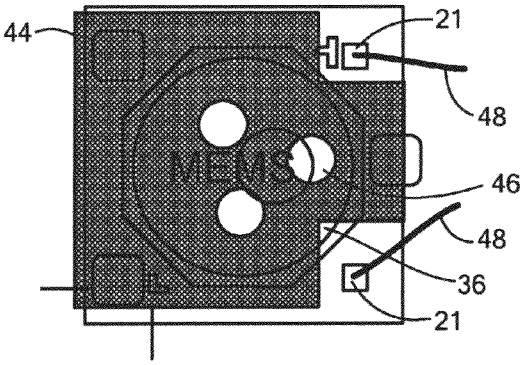
FIGS. 6B-6D schematically show top views of the packaged microphone of FIGS. 2 and 3 with the lid removed during various stages of the packaging process.

To further reduce its impact on normal microphone operation, the stop member 44 also may have one or more relief holes 46 or other similar features to relieve squeeze film damping effects it may produce. FIG. 6B, for example, shows a top view of the stop member 44 and its plurality of pressure relief holes 46. Moreover, this view also shows that the stop member 44 does not necessarily cover the entire surface area of the diaphragm 36. Instead, the stop member 44 may have portions around its periphery that, from a plan view, do not cover the diaphragm 36. In fact, some embodiments may implement the stop member 44 to have a very small surface area. For example, such embodiments may implement the stop member 44 as a mesh or other structure that, if necessary, merely provides point or line contact to the diaphragm 36. To improve manufacturability, some embodiments may form a single large hole 46 through the stop member 44. This single hole 46 may have a diameter that is slightly smaller than the diameter of the diaphragm 36 and, in some embodiments, is generally concentric with the diaphragm 36. Accordingly, the stop member 44 contacts the outer periphery of the diaphragm 36 only during a high pressure event.

To ensure proper microphone performance, illustrative embodiments mitigate the electrostatic impact of the stop member 44 on the diaphragm 36. For example, the stop member 44 may have a floating voltage, a negligible voltage (e.g., if it were formed from a non-conductive material), or have a controlled bias voltage, such as a voltage that is substantially equal to that of the diaphragm 36. The stop member 44 nevertheless cannot be considered to be a backplate 34 and thus, does not form a variable capacitance that is used in any manner by the ASIC or packaged microphone 10. Instead, the stop member 44 generally is a substantially inert, generally electrically irrelevant member with a principal function of limiting the maximum distance that the diaphragm 36 may move. As known by those skilled in the art, incidental electrostatic interaction with the diaphragm 36 does not transform it into a backplate 34, especially where it does not perform such a function within the packaged microphone 10.

Figure 6C:
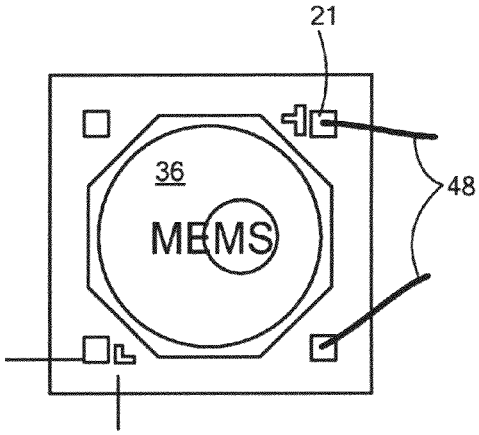
Figure 6D:
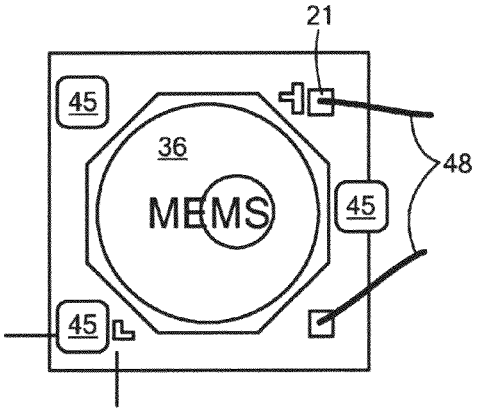

FIGS. 6C and 6D schematically show additional plan views of the microphone die 20 before the stop member 44 is secured to its top surface. As noted above, details of this process are discussed below with regard to FIG. 8.

Figure 7:
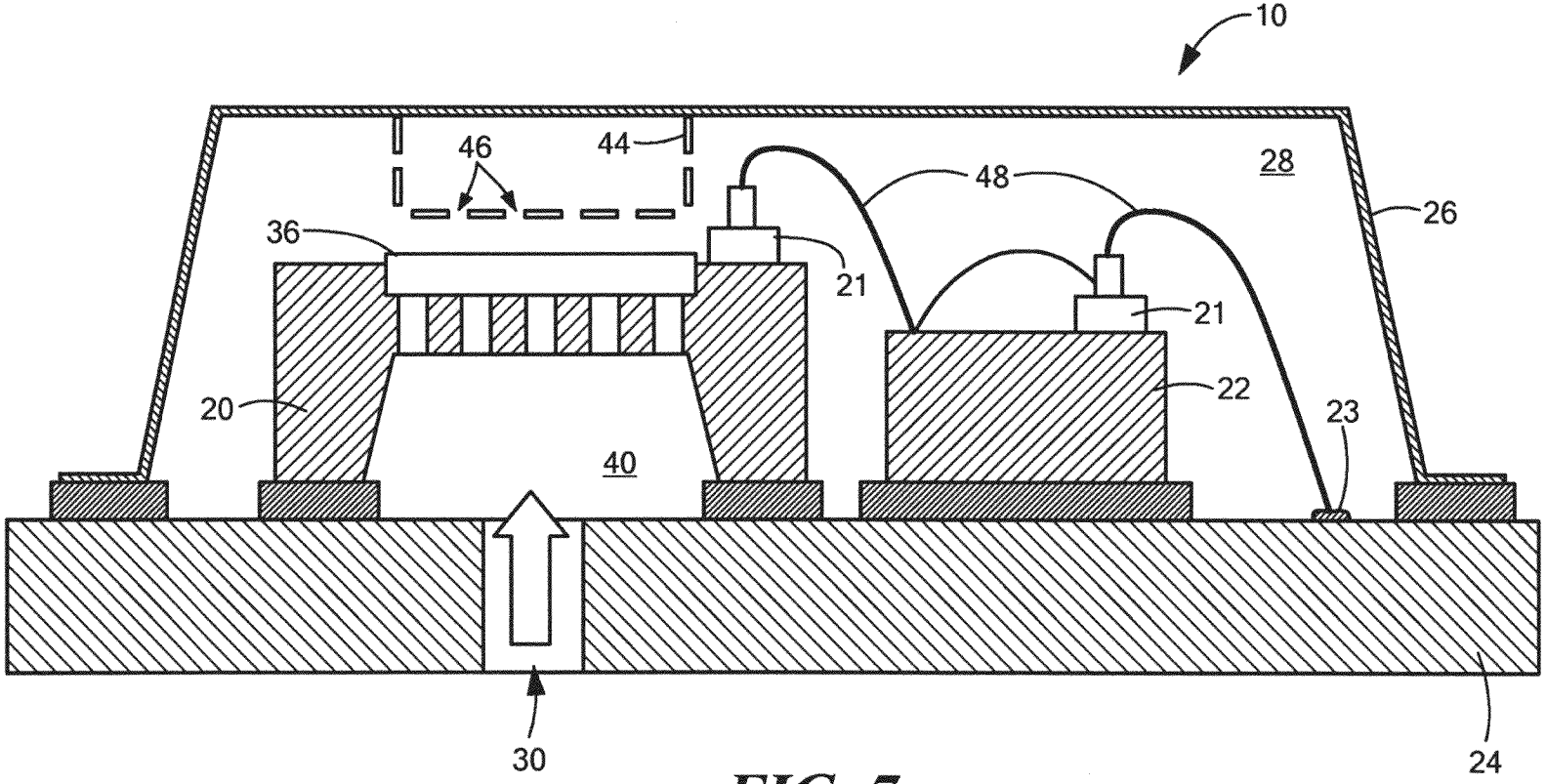
FIG. 7 schematically shows a cross-sectional view of the packaged microphone of FIGS. 2 and 3 in accordance with an alternative embodiment of the invention.

Alternative embodiments do not form the stop member 44 directly on the microphone die 20. FIG. 7 schematically shows one such embodiment, in which the stop member 44 extends downwardly (from the perspective of the drawings) from the interior surface of the lid 26, but does not contact the microphone die 20 in any manner when the diaphragm 36 is in its equilibrium position. Like the embodiment described above with regard to FIG. 6A, this embodiment also is configured to minimize its impact on diaphragm movement. As such, like the stop member 44 in FIG. 6A, this stop member 44 also has features (e.g., apertures) that permit airflow through its body, and may be spaced far enough from the diaphragm 36 to reduce its damping effect on the diaphragm 36. In addition, also like the stop member 44 discussed above with regard to FIG. 6A, this stop member 44 also may have a minimum potential contact area with the diaphragm 36, and minimal electrostatic interaction with the diaphragm 36 (e.g., the stop member 44 also does not form or perform the function of a backplate 34).

Discussion of the specific stop member configurations of FIGS. 6A and 7 are but two of a number of different potential implementations. Those skilled in the art therefore can configure the stop member 44 in any number of additional manners, such as a stop member 44 that is merely around at least a portion of the periphery of the diaphragm 36, or only at certain locations (e.g., a collection of spaced apart components that effectively form a single stop member 44).

Figure 8:
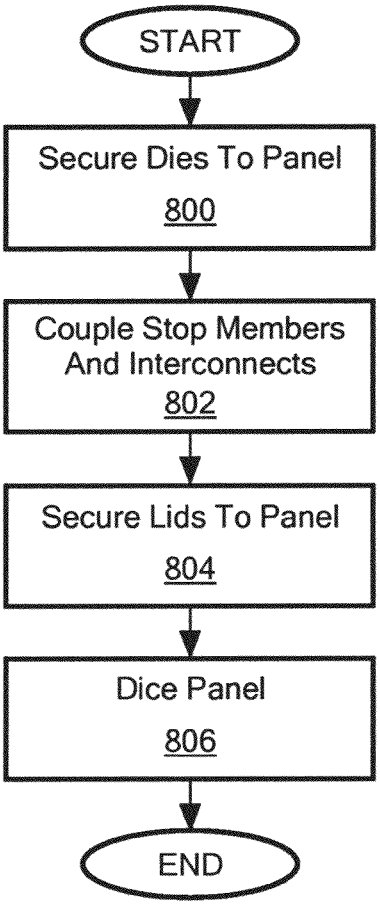
FIG. 8 shows a process of producing the packaged microphone accordance with illustrative embodiments of the invention.

FIG. 8 shows a process of forming the microphone system/packaged microphone 10 in accordance with illustrative embodiments of the invention. It should be noted that for simplicity, this described process is a significantly simplified version of an actual process used to form the microphone system 10. Accordingly, those skilled in the art would understand that the process may have additional steps and details not explicitly shown in FIG. 8. Moreover, some of the steps may be performed in a different order than that shown, or at substantially the same time. Those skilled in the art should be capable of modifying the process to suit their particular requirements.

In illustrative embodiments, the packaged microphone 10 is formed in a batch process that simultaneously forms dozens, hundreds, or even thousands of packaged microphones at the same time. To that end, this process is described as using panels of packaging material (e.g., laminate, FR-4, ceramic substrate material, or pre-molded leadframe packaging) that ultimately form the bases 24 of each of the packaged microphones 10. It nevertheless should be noted that those skilled in the art can apply these techniques to other batch processes, or processes that form only one microphone at a time.

The process begins at step 800, which secures the microphone die 20 and ASIC die 22 to the base 24. More specifically, the panel is considered to have a two dimensional array of individual bases 24 that each ultimately form a portion of a single packaged microphone 10. Each base 24 has its preformed inlet aperture 30 and configuration of contacts/pads 32 on its upper surface. Accordingly, the process first may apply adhesive to the panel at prescribed locations on the upper panel surface. This adhesive may be a conductive or non-conductive epoxy commonly used in the MEMS packaging space. Next, this step may place an array of microphone dies 20 in designated location over their respective inlet apertures 30, and an array of ASICs in their designated locations next to the microphone dies 20. The step also may position passive components or other devices onto prescribed portions of the panel. The cured adhesive effectively secures each of these components to the panel.

After the components are secured to the panel, the process continues to step 802, which electrically connects the microphone dies 20 and ASICs 22 to their bases 24, and couples the stop members 44 to the microphone dies 20. Specifically, this step first applies a conductive adhesive to certain pads 21 on the top surfaces of the microphone dies 20 and the ASIC dies 22. This step also applies the conductive adhesive to pads 23 on the top face of the panel. As shown in FIG. 6C, this step next secures wire bonds 48 between the microphone dies 20 and their respective ASIC dies 22, and between the ASIC dies 22 and those pads 23 on the top face of the panel with the adhesive. Alternatively, some embodiments may directly connect the microphone die 20 to the panel. In that case, the ASIC die 22 and microphone die 20 electrically communicate through electrical traces or conductive paths within the base 24.

Next, as shown in FIG. 6D, this step dispenses stop adhesive 45 onto the top surfaces of the array of microphone dies 20. Those skilled in the art should understand that the stop adhesive 45 is carefully dispensed and selected, and the stop members 44 are placed in a specific manner (e.g., with a specified downward pressure) to ensure that the distance between the stop member 44 and the diaphragm 36 is a certain prescribed distance from the diaphragm 36. Of course, this distance is subject to certain manufacturing tolerances commonly associated with conventional packaging processes.

To provide more precision in the spacing between the stop members 44 and microphone dies 20, some embodiments may place protruding features (e.g., fillets) on the stop member 44 or the microphone die 20 to more precisely position the stop members 44. For example, such embodiments may have downwardly protruding fillets or other protrusions from the stop member 44 that contact but do not adhesively couple with the microphone die 20—they only make contact with the microphone die 20. Accordingly, the stop adhesive 45 can more coarsely couple the members together while the protrusions provide the precise spacing and planar relationships.

To minimize any interference with the movement of the diaphragm 36, this stop adhesive 45 preferably does not contact the diaphragm 36 or springs 42 of any microphone die 20. If used in the embodiment in which the stop member 44 has a controlled voltage, then this adhesive optionally may be conductive and positioned over additional pads 21 on the top surfaces of the microphone dies 20. After dispensing the stop adhesive 45, this step then places the stop members 44 directly on their respective microphone dies 20 (e.g., see FIG. 6B).

It should be noted that the stop adhesive application and stop member placement portions of this step may be omitted if the stop member 44 was formed directly on the microphone die 20 during the fabrication process.

Step 804 then secures the lids 26 to the panels by conventional means. For example, the process may apply a plurality of rings of adhesive about each base 24 on the panel. Some embodiments may use a conductive adhesive to appropriately control the potential of the lids 26. For example, such embodiments may normally ground the potential of the lid 26 during use.

At this point, the panel may be considered to have a plurality of independently functional packaged microphones 10. Accordingly, the process concludes at step 806, which dices the panel along prescribed lines in the panel to form the plurality of independent packaged microphones 10. Just prior to dicing, however, some embodiments may test the devices using conventional testing/probe processes.

Accordingly, using one or more simple stop members 44 as ruggedizing reinforcement, illustrative embodiments significantly enhance the robustness and potential usable lifespan of a microphone die 20 mounted with its backplate 34 in the front volume. Expensive flip-chip equipment is not required to protect the diaphragm 36. In fact, regardless of its mounting within the interior chamber 28, such a design is expected to better withstand undesired high pressure acoustic signals than those designs that do not have a stop member 44.

Although the above discussion discloses various exemplary embodiments of the invention, it should be apparent that those skilled in the art can make various modifications that will achieve some of the advantages of the invention without departing from the true scope of the invention.

What is claimed is:

1. A microphone system comprising:

a package having an interior chamber and an inlet aperture for receiving an acoustic signal;

a single backplate microphone die having a single backplate and a diaphragm that together form a single plate variable capacitance, the single backplate microphone die being positioned to form a front volume between the diaphragm and the inlet aperture within the package interior, the single backplate microphone die being positioned to form a back volume defined in part by the diaphragm within the interior chamber;

a stop member positioned in the back volume and generally over the moveable portion of the diaphragm, the diaphragm being between the stop member and the backplate, wherein the diaphragm has a generally planar top surface, the stop member being spaced a given distance from the top surface of the diaphragm to limit orthogonal movement of the diaphragm in a direction that is generally normal to the top surface of the diaphragm, the maximum orthogonal movement being about the given distance, the diaphragm and backplate being spaced a second distance apart, the given distance being different from the second distance.

2. The microphone system as defined by claim 1 wherein the stop member is secured to the single backplate microphone die, the distance between the stop member and the diaphragm being a first distance, the distance between the backplate and diaphragm being a second distance, the first distance being different from the second distance.

3. The microphone system as defined by claim 1 wherein the package has at least one interior wall that defines the interior chamber, the stop member being coupled to the at least one interior wall.

4. The microphone system as defined by claim 1 wherein the stop member comprises a generally planar member forming at least one opening therethrough.

5. The microphone system as defined by claim 1 wherein the stop member comprises a laminate.

6. The microphone system as defined by claim 1 wherein the single backplate microphone die is positioned to substantially cover the inlet aperture.

7. The microphone system as defined by claim 1 wherein the package comprises a base forming the inlet aperture, and a lid secured to the base, the lid and base forming the interior chamber, the package further having a plurality of pads on the base.

8. The microphone system as defined by claim 1 wherein the stop member has a floating potential or has a potential that is substantially the same as the potential of the diaphragm.

9. The microphone system as defined by claim 1 wherein the stop member and single backplate microphone die are in a stacked configuration.

10. A microphone system comprising:

a base;

a lid that at least with the base forms a package having an interior chamber, the package having an inlet aperture for receiving an acoustic signal;

a single backplate microphone die within the interior chamber and having a diaphragm with a movable portion, the single backplate microphone die being mounted over and covering the inlet aperture; and a stop member proximate to the single backplate microphone die and positioned generally over the moveable portion of the diaphragm, the single backplate microphone die being between the inlet aperture and the stop member wherein the diaphragm is movable in response to receipt of an acoustic signal, the diaphragm having a generally planar top surface, the stop member being spaced a given distance from the top surface of the diaphragm to limit orthogonal movement of the diaphragm in a direction that is generally normal to the top surface of the diaphragm, the maximum orthogonal movement being about the given distance.

11. The microphone system as defined by claim 10 wherein the stop member is secured to the single backplate microphone die.

12. The microphone system as defined by claim 10 wherein the stop member comprises a generally planar member forming at least one opening therethrough.

13. The microphone system as defined by claim 10 wherein the stop member and single backplate microphone die are in a stacked configuration.

14. The microphone system as defined by claim 10 wherein the stop member has a generally planar bottom face, the microphone having a generally planar diaphragm, the diaphragm being generally parallel with the bottom face of the stop member.

15. A microphone system comprising:

a base;

a lid that at least with the base forms a package having an interior chamber, the package having an inlet aperture for receiving an acoustic signal;

a single backplate microphone die within the interior chamber, the single backplate microphone die being mounted over and covering the inlet aperture, the single backplate microphone die having a diaphragm suspended by at least one spring, the single backplate microphone die also having a single backplate that forms a variable capacitor with the diaphragm, the diaphragm having a generally planar top face, the spring permitting the diaphragm to move a maximum distance in a direction that is generally orthogonal to the top face of the diaphragm, the maximum distance being a distance that could damage the single backplate microphone die; and a stop member positioned generally over the moveable portion of the diaphragm and being positioned proximate to and spaced a given distance from the diaphragm in a direction that is generally orthogonal to the top face of the diaphragm, the given distance being less than the maximum dimension, the stop member being between the diaphragm and the lid and preventing the diaphragm from moving more than the given distance.

16. The microphone system as defined by claim 15 wherein moving the diaphragm the maximum distance could damage the diaphragm, the spring, or both the spring and the diaphragm.

17. The microphone system as defined by claim 15 wherein the stop member is coupled with the single backplate microphone die.

18. The microphone system as defined by claim 15 wherein the backplate is positioned between the diaphragm and the inlet aperture.

19. The microphone system as defined by claim 1 as defined by claim 1 wherein the single backplate microphone die being mounted over and covering the inlet aperture and being positioned between the inlet aperture and the stop member.

20. The microphone system as defined by claim 10 wherein the single backplate microphone die being mounted over and covering the inlet aperture and being positioned between the inlet aperture and the stop member.

21. The microphone system as defined by claim 15 wherein the single backplate microphone die being mounted over and covering the inlet aperture and being positioned between the inlet aperture and the stop member.

* * * * *